US009337529B2

(12) United States Patent
Cui

(10) Patent No.: US 9,337,529 B2
(45) Date of Patent: May 10, 2016

(54) PORTABLE TERMINAL

(71) Applicants: Beijing Lenovo Software Ltd., Haidian District, Beijing (CN); Lenovo (Beijing) Co., Ltd., Beijing (CN)

(72) Inventor: Bin Cui, Beijing (CN)

(73) Assignees: BEIJING LENOVO SOFTWARE LTD., Haidian District, Beijing (CN); LENOVO (BEIJING) CO., LTD., Haidian District, Beijing (CN)

( * ) Notice: Subject to any disclaimer, the term of this patent is extended or adjusted under 35 U.S.C. 154(b) by 229 days.

(21) Appl. No.: 14/090,325

(22) Filed: Nov. 26, 2013

(65) Prior Publication Data

US 2014/0145886 A1 May 29, 2014

(30) Foreign Application Priority Data

Nov. 27, 2012 (CN) ..... 2012 1 0492560

(51) Int. Cl.
*H01Q 1/24* (2006.01)

(52) U.S. Cl.
CPC ..... *H01Q 1/243* (2013.01)

(58) Field of Classification Search
USPC ..... 343/702, 767, 770
See application file for complete search history.

(56) References Cited

U.S. PATENT DOCUMENTS

2004/0164907 A1* 8/2004 Killen ..... H01Q 9/0457 343/700 MS
2008/0001836 A1* 1/2008 Guthrie ..... H01Q 13/10 343/767
2009/0153410 A1* 6/2009 Chiang ..... H01Q 13/08 343/702
2014/0266950 A1* 9/2014 Cicero ..... H01Q 1/28 343/789
2015/0145740 A1* 5/2015 Fratti ..... H01Q 1/40 343/767

FOREIGN PATENT DOCUMENTS

CN 102227036 A 10/2011
CN 102255134 A 11/2011
CN 102368575 A 3/2012
CN 102593578 A 7/2012
CN 202308322 U 7/2012
JP 2001-016019 A 1/2001

OTHER PUBLICATIONS

Chinese First Office Action with English Translation for related Application No. 201210492560.4 dated Jun. 24, 2015, 10 pages.
Second Office Action dated Jan. 29, 2016 out of corresponding Chinese priority Application No. CN 201210492560.4 (7 pages including English translation).

* cited by examiner

*Primary Examiner* — Tan Ho
(74) *Attorney, Agent, or Firm* — Brinks Gilson & Lione; G. Peter Nichols

(57) ABSTRACT

A portable terminal is described where the portable terminal includes a first frame body and a second frame body. The first frame body is used for an antenna unit of the portable terminal and a gap is set in a first partial area of the first frame body with the first partial area with a gap being set is covered by the second frame body.

13 Claims, 3 Drawing Sheets

PORTABLE TERMINAL

BACKGROUND

This application claims priority to Chinese patent application No. 201210492560.4 filed on Nov. 27, 2012, the entire contents of which are incorporated herein by reference.

The present application relates to a field of portable terminal.

In recent years, with the demand for smaller, thinner and more metallic portable terminals, the design of conventional antenna is facing extreme challenges. Especially in the case of metal frames, conventional antenna is hard to be thinner.

In this case, there is a way in the art, in which the metal frame of the portable terminal is used as the antenna, which helps with solving the problem of environment deterioration of built-in antenna. However, since when the user is holding the portable terminal, it is very likely to touch the gap near the metal frame, short-circuited is caused to deteriorate the signal badly.

SUMMARY

In view of the above-described case, the invention discloses a portable terminal, which can not only realize the design of thinner and smaller, but also can solve the problem of easily being short-circuited when the terminal is be held by the user, which improves the signal quality significantly.

According to one embodiment of the invention, a portable terminal is provided, wherein: the portable terminal includes a first frame body and a second frame body; the first frame body is used for an antenna unit of the portable terminal; a gap is set in a first partial area of the first frame body; the first partial area with a gap being set is covered by a second partial area of the second frame body.

Optionally, material of the first frame body is metal, the first partial area with a gap being set forms a gap antenna.

Optionally, material of the second frame body is insulating material.

Optionally, the width of the first partial area is smaller than the width of the rest areas excluding the first partial area in the first frame body.

Optionally, the sum of the width of the first partial area and the width of the second frame body equals to the width of the rest areas.

Optionally, the portable terminal has a display surface, a rear surface opposite to the display surface, and a side surface which is perpendicular to the display surface and the rear surface, the first frame body is surrounding the outer side of the side surface, the width of the first partial area is the length of the first partial area along the perpendicular direction of the side surface.

Optionally, the thickness of the first partial area is less than the thickness of the rest areas excluding the first partial area in the first frame body.

Optionally, the portable terminal has a display surface, a rear surface opposite to the display surface, and a side surface which is perpendicular to the display surface and the rear surface, the first frame body is surrounding the outer side of the side surface, the thickness of the first partial area is the length of the first partial area along the direction of the side surface.

Optionally, a feedpoint of the antenna unit is set at the gap or at a location other than the gap in the first frame body.

Optionally, the feedpoint is set at apex corners of the first frame body.

Optionally, the first frame body includes straight strips for surrounding the second frame body and oblique strips or curved strips for connecting the adjacent straight strips.

Optionally, the number of the gaps is multiple.

Optionally, the feedpoint of the antenna includes at least one of a GPS antenna feedpoint, a Wi-Fi/BT antenna feedpoint, a main antenna feedpoint, and a diversity antenna feedpoint.

In the portable terminal according the embodiments of the invention, by hiding the gaps of the metal frame antenna elaborately, it can not only achieves a thinner, smaller design, but also improves the user experience, not to mention it also solves the problem of short-circuit easily caused when the portable terminal is being held by the user, which increases the signal quality significantly.

DETAILED DESCRIPTION

A portable terminal according to the embodiments of the invention will be described with reference to accompanying figures hereafter.

It should be noted, FIG. 1- FIG. 4 are schematically shown in order to describe the portable terminal according to the embodiments of the invention. FIG. 1-FIG. 4 should be considered to be exemplary in all aspects, instead of being restrictive. Additionally, the size and proportion of various components in FIG. 1-FIG. 4 are merely schematic, instead of being drawn according to the actual size and proportion.

Figure 1:
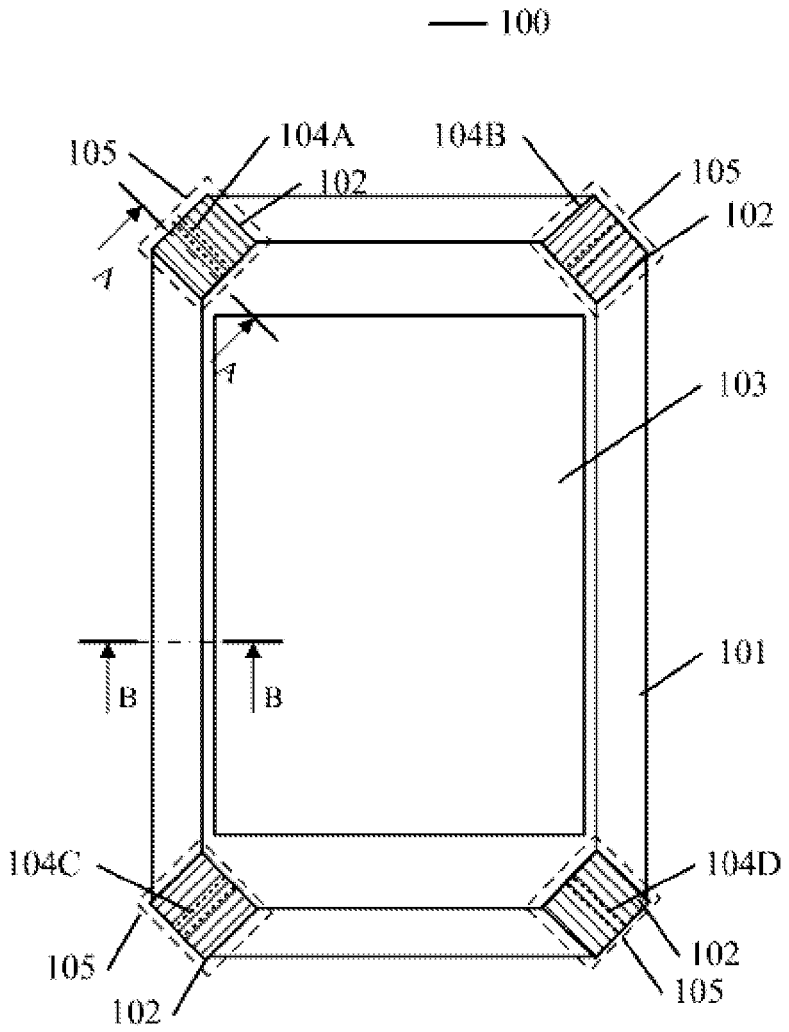
FIG. 1 is the main view illustrating a portable terminal according to one embodiment of the invention.

Firstly, with reference to FIG. 1. FIG. 1 is the main view illustrating a portable terminal according to one embodiment of the invention. As shown in FIG. 1, the portable terminal 100 according to one embodiment of the invention includes a first frame body 101 and a second frame body 102. In FIG. 1, the first frame body 101 is illustrated as a blank frame body, and the second frame body 102 is illustrated as a shaded frame body. A first partial area of the first frame body 101 is set with gaps, as shown by pairs of dash lines (104A, 104B, 104C, and 104D) in FIG. 1. Therefore, the first frame body 101 forms a gap antenna. That is, the first frame body 101 is used for the antenna unit of the portable terminal.

In the portable terminal according to the embodiments of the invention, the first partial area being set with gaps is covered by the second frame body. In FIG. 1, since the first partial area of the first frame body 101 is covered by the second partial area of the second frame body 102, the first partial area and the second partial area are collectively shown by the dash frame 105.

Specifically, as shown in FIG. 1, in addition to the first frame body 101 and the second frame body 102, the portable terminal 100 can further include a main body part 103. The main body part 103 includes a main surface (e.g., a display surface), a rear surface opposite to the main surface, and a side surface. The first frame body 101 is constructed to surround the outer side of the main body part 103. The second frame body 102 is constructed to cover the outer side of the first partial area 104A-104D of the first frame body 101.

In the portable terminal according to the embodiment of the invention, by hiding the gaps of the metal frame antenna elaborately, on one hand, it achieves a thinner, smaller design in an extremely economical way and improves the user experience; on the other hand, it solves the problem of short-circuit easily caused when the portable terminal is being held by the user, which increases the signal quality significantly.

Figure 2:
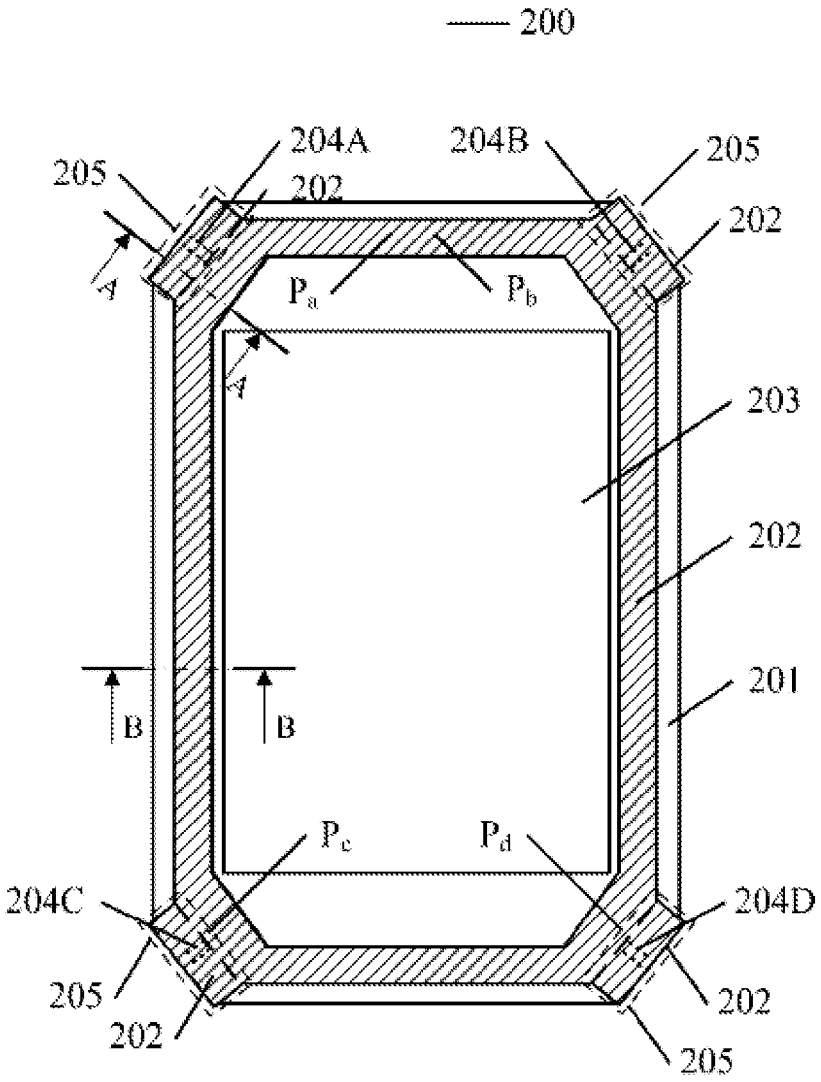
FIG. 2 is the main view illustrating a portable terminal according to another embodiment of the invention.

Hereafter, with reference to FIG. 2, the main view of a portable terminal according to another embodiment of the invention will be described. As shown in FIG. 2, the portable terminal 200 according to another embodiment of the invention includes a first frame body 201 and a second frame body 202. In FIG. 2, similarly, the first frame body 201 is illustrated as a blank frame body, and the second frame body 202 is illustrated as a shaded frame body. A first partial area of the first frame body 201 is set with gaps, as shown by pairs of dash lines (204A, 204B, 204C, and 204D) in FIG. 2. Therefore, the first frame body 201 forms a gap antenna. That is, the first frame body 201 is used for the antenna unit of the portable terminal.

In the portable terminal according to the embodiments of the invention, the first partial area being set with gaps is covered by the second frame body. In FIG. 2, since the first partial area of the first frame body 201 is covered by the second partial area of the second frame body 202, the first partial area and the second partial area are collectively shown by the dash frame 205.

Specifically, as shown in FIG. 2, in addition to the first frame body 101 and the second frame body 202, the portable terminal 200 can further includes a main body part 203.The main body part 203 includes a main surface (e.g., a display surface), a rear surface opposite to the main surface, and a side surface. The first frame body 101 is constructed to surround the outer side of the main body part 203.The second partial area of the second frame body 201 is constructed to cover at the outer side of the first partial area 204A-204D of the first frame body 201 .The rest areas excluding the second partial area in the second frame body 202 are constructed to grip the rest areas excluding the first partial area in the first frame body 201 by the both sides of the display surface and the rear surface, that is, along the direction perpendicular to the display surface, the rest areas excluding the first partial area in the first frame body 201 are made to position between the rest areas excluding the second partial area in the second frame body 202.

In the portable terminal according to the embodiment of the invention, by hiding the gaps of the metal frame antenna elaborately, on one hand, it achieves a thinner, smaller design in an extremely economical way and improves the user experience; on the other hand, it solves the problem of short-circuit easily caused when the portable terminal is being held by the user, which increases the signal quality significantly.

Figure 3:
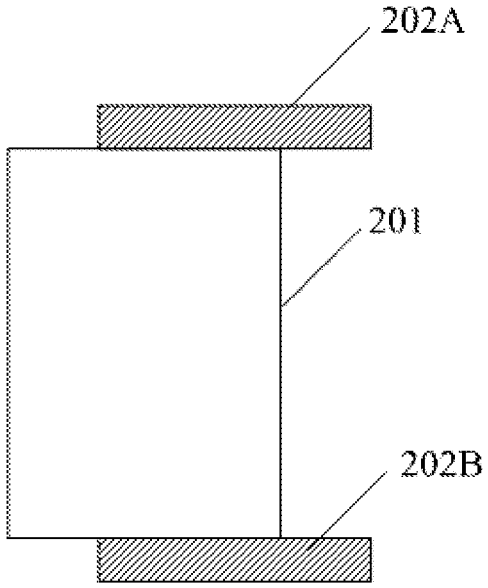
FIG. 3 illustrates the B-B direction section view obtained along the B-B cutting line shown in FIG. 1.

FIG. 3 illustrates the B-B direction section view obtained by cutting the first frame body 201 and the second frame body 202 along the B-B cutting line shown in FIG. 2 (i. e. , at the rest areas excluding the first partial area in the first frame body 201 and the rest areas excluding the second partial area in the second frame body 202). Likewise, the first frame body is illustrated as a blank frame body, and the second frame body is illustrated as a shaded frame body.

Specifically, as shown in the B-B direction section view in FIG. 3, the portable terminal includes the first frame body 201, as well as the second frame body 202A and 202B, in which, the second frame body 202A and 202B both correspond to the second frame body 202 shown in FIG. 2. Specifically, the second frame body 202A, for example, is positioned at the display surface side of the portable terminal, and the second frame body 202B, for example, is positioned at the rear surface side of the portable terminal, vice versa.

Figure 4:
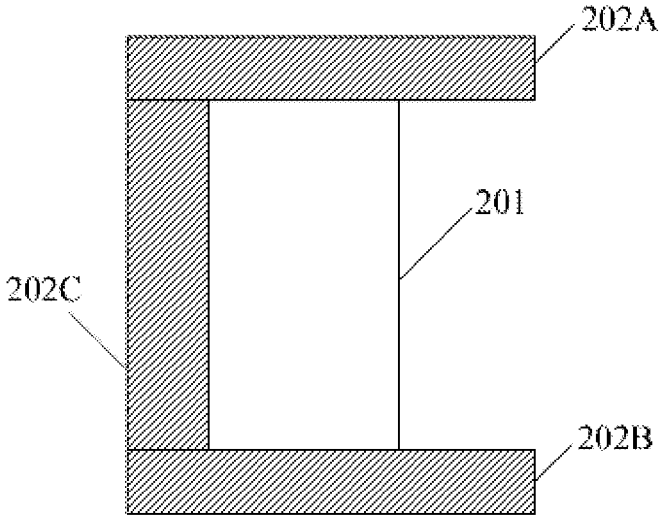
FIG. 4 illustrates the A-A direction section view obtained along the A-A cutting line shown in FIG. 1.

Comparatively, FIG. 4 illustrates the embodiment of A-A direction section view obtained by cutting the first frame body 201 and the second frame body 202 along the A-A cutting line shown in FIG. 2 (i. e. , at the second partial area of the second frame body 202 and the first partial area of the first frame body 201). Likewise, the first frame body is illustrated as a blank frame body, and the second frame body is illustrated as a shaded frame body.

Specifically, as shown in the A-A direction section view of FIG. 4, the portable terminal includes the first frame body 201, as well as the second frame body 202A, 202B and 202C, in which, the second frame body 202A, 202B and 202C collectively correspond to the second frame body 202 shown in FIG. 2. Specifically, the second frame body 202A, for example, is positioned at the display surface side of the portable terminal, the second frame body 202B, for example, is positioned at the rear surface side of the portable terminal, and the second frame body 202C, for example, is positioned at the side surface of the portable terminal.

As shown in FIG. 4, the first partial area of the first frame body 201 is covered by the second partial area of the second frame body 202. Therefore, the gaps of the metal frame antenna is elaborately hidden and the problem of easily being short-circuited when the terminal is be held by the user is solved.

It should be noted that, FIG. 3 and FIG. 4 are section views of the portable terminal according the embodiment in FIG. 2. Though not shown, those skilled in the art should understand that, the section view of the portable terminal according the embodiment in FIG. 1 is similar to the section views of FIG. 3 and FIG. 4, except the second frame body 202A and the second frame body 202B shown in FIG. 3 are not included, and the detail description is omitted.

Moreover, in the portable terminal according to above-described embodiments of the invention, in one example, it can be such configured that the width of the first partial area is smaller than the width of the rest areas excluding the first partial area in the first frame body.

Furthermore, it can be such configured that the sum of the width of the first partial area and the width of the second frame body equals to the width of the rest areas.

It should be noted that, in the above examples, as described above, the portable terminal has a display surface, a rear surface opposite to the display surface, and a side surface which is perpendicular to the display surface and the rear surface. The first frame body is surrounding the outer side of the side surface. Therefore, the width of the first partial area referred to herein is the length of the first partial area along the perpendicular direction of the side surface. Likewise, the width of the rest areas equals to the length of the rest areas along the perpendicular direction of the side surface.

Moreover, in the portable terminal according to above-described embodiments of the invention, in another example, it can be such configured that, the thickness for the first partial area is smaller than the thickness of the rest areas excluding the first partial area in the first frame body.

It should be noted that, in the above-described examples, the thickness of the first partial area equals to the length of the first partial area along the direction of the side surface. Likewise, the thickness of the rest areas equals to the length of the rest areas along the direction of the side surface.

Furthermore, in this example, it should be understood by those skilled in the art that, since the second frame body covers the first frame body at the first partial area, the combination of these frame bodies has a broader width than that of the rest areas. However, it should be also understood by those skilled in the art that, the thickness and the width of the first frame body within the first partial area can be reduced in advance, so that the first partial area of the first frame body is consistent with the rest areas in both width and thickness after the second frame body covers the first frame body at the first partial area. As shown in FIG. 2, the second frame body has a rectangle-like shape with four apex corners protruding outward slightly. Or, the rectangle-like shape is integrally formed by chopping off the four apex corners after the second frame body covers the first frame body.

According to the above-described examples, it is possible to smooth the design of the portable terminal, so that the user experience may be further improved.

Moreover, in one embodiment of the invention, material of the first frame body may be metal, so that the first partial area with gaps being set forms a gap antenna. Those skilled in the art may construct the first frame body with any appropriate metal material; therefore it is not specified in the description.

In another embodiment of the invention, material of the second frame body may be insulation material, e.g., plastics, etc. Of course, those skilled in the art may construct the second frame body with any appropriate insulation material other than the above described material; therefore it is not specified in the description.

Moreover, the number of the gaps may be one or more than one. The gaps may be positioned at the apex corners of the first frame body, but may also be positioned at any other appropriate locations.

Correspondingly, the number of the feedpoints of the antenna unit may be one or more than one. For example, the feedpoints of the antenna unit may include at least one of multiple antenna feedpoints of a GPS antenna feedpoint, a Wi-Fi/BT antenna feedpoint, a main antenna feedpoint, a diversity antenna feedpoint and so on. Of course, it is apparent to those skilled in the art that the portable terminal according to the embodiments of the invention may include any other antenna feedpoints besides the above-described ones depending on the design requirements.

Moreover, the feedpoints of the antenna unit may be positioned at the gaps, or at locations excluding the gaps in the first frame body. Specifically, for example, the portable terminal 200 shown in FIG. 2 includes four antenna feedpoints Pa, Pb, Pc, and Pd, in which feedpoints Pc and Pd are positioned at the gaps, and feedpoints Pa and Pb are positioned at locations excluding the gaps in the first frame body 201. For example, the feedpoint Pa may correspond to the GPS antenna feedpoint. The feedpoint Pb may correspond to the Wi-Fi/BT antenna feedpoint. The feedpoint Pc may correspond to the main antenna feedpoint. The feedpoint Pd may correspond to the diversity antenna feedpoint.

Of course, those skilled in the art can understand that, those above-described feedpoints settings are merely examples. Those skilled in the art may position the feedpoints at any appropriate locations in the first frame body 201 depending on design requirements.

By the second frame body of insulation material covering the gap area of the first frame body which is the gap antenna, the portable terminal according to the embodiments of the invention solves the problem of easily being short-circuited while being held by the user, which improves the signal quality significantly.

Therefore, the portable terminal according to the embodiments of the invention is described with reference to FIG. 1 to FIG. 4.

In the portable terminal according to the embodiments of the invention, by hiding the gaps of the metal frame antenna elaborately, on one hand, it achieves a thinner, smaller design in an extremely economical way and improves the user experience; on the other hand, it solves the problem of easily being short-circuit when the portable terminal is being held by the user, which increases the signal quality significantly.

It should be noted that, in the specification, the usage of terms "include", "contain" or any other variations which cover the meanings of inclusively including causes the including processes, methods, things or the equipments of series of elements includes not only those elements, but also other elements without being listed exactly, and further includes inherent elements of the processes, the methods, the things or the equipments. In the case of without be further restricted, the element defined by the phrase "includes a/an" does not exclude any other same elements included in the processes, the methods, the things or the equipments of the element.

When a component or a layer is expressed as being "on another component or another layer", "attached to", "connected to" or"coupled to" another component or another layer, it may be on another component or another layer directly or directly attached to, directly connected to, or directly coupled to another component or another layer, or with one or more intermediate components or layers. On the contrary, when a component or a layer is expressed as being "on another component or another layer directly", "directly attached to", "directly connected to " or "directly coupled to" another component or another layer, it may exist no intermediate component or layer. Other phrases or words used to describe the relationships between components should be appreciated in a similar way (for example, "between" compares with "directly between", "adjacent to" compares with "directly adjacent to", etc). Term "and/or" includes any combination of or all combination of one or more listed relevant items.

Although terms "first", "second", "third" and so on may be used here to describe various of components, members, areas, layers and/or parts, these components, members, areas, layers and/or parts are not restricted by those terms. These terms may only be used to differentiate one component, one member, one area, one layer and/or one part from another component, another member, another area, another layer and/or another part. For example, terms "first", "second" and other numerical terms means no priority and/or order in the description, unless otherwise specified. In this way, the first component, member, area, layer and/or part may presented as the second component, member, area, layer and/or part, without departing from the teaching of exemplary embodiment.

Space relativity terms, e.g., "in", "out", "below", "under", "down", "above", "up", etc, may be used here to describe a relationship of a component or a feature between another component or another feature as shown in the figures for description. Space relativity terms may be meant to include different directions of devices during usage and operation, besides the directions described in the figures. For example, if devices in the figures were upside-down, components described as "below" or "under" other components or features would be then "above" or "on" other components or features. In this way, the exemplary term "below" may include up and down directions. The devices may have other directions(rotated by 90°, or rotated in other directions), the space relativity terms used here may have corresponding explanations.

The details of the invention have been introduced above, and the principle of the invention and the embodiments have been explained with specific examples. The above description of the embodiments is merely for the help of understanding the method and idea of the invention. Meanwhile, for those skilled in the art, there may exist variations in the embodiments and applications, depending on the ideas of the invention. To sum up, the content of the description should not be appreciated as the restriction of the invention.

The invention claimed is:

1. A portable terminal comprising:

a first frame body and a second frame body;

the first frame body is used for an antenna unit of the portable terminal;

a gap set in a first partial area of the first frame body;

a display surface side, a rear surface side, and a side surface of the first partial area with the gap being set are all covered by the second frame body.

2. The portable terminal according to claim 1, wherein material of the first frame body is metal, and the first partial area with the gap being set forms a gap antenna.

3. The portable terminal according to claim 1, wherein material of the second frame body is insulating material.

4. The portable terminal according to claim 1, wherein a width of the first partial area is smaller than a width of a remaining portion that excludes the first partial area in the first frame body.

5. The portable terminal according to claim 4, wherein the sum of the width of the first partial area and a width of the second frame body equals the width of the remaining portion.

6. The portable terminal according to claim 4, wherein the portable terminal has a display surface, a rear surface opposite to the display surface, and a side surface perpendicular to the display surface and to the rear surface, the first frame body surrounding the outer side of the side surface, the width of the first partial area is a length of the first partial area along a perpendicular direction of the side surface.

7. The portable terminal according to claim 1, wherein a thickness of the first partial area is less than a thickness of a remaining portion that excludes the first partial area in the first frame body.

8. The portable terminal according to claim 7, wherein the portable terminal has a display surface, a rear surface opposite to the display surface, and a side surface perpendicular to the display surface and the rear surface, the first frame body surrounding the outer side of the side surface, and a thickness of the first partial area defined by a length of the first partial area along the direction of the side surface.

9. The portable terminal according to claim 1, wherein a feedpoint of the antenna unit is set at the gap or at a location other than the gap in the first frame body.

10. The portable terminal according to claim 1, wherein the feedpoint is set at apex corners of the first frame body.

11. The portable terminal according to claim 1, wherein the first frame body includes straight strips for surrounding the second frame body and oblique strips or curved strips for connecting adjacent straight strips.

12. The portable terminal according to claim 1, wherein the number of gaps is multiple.

13. The portable terminal according to claim 1, wherein the feedpoint of the antenna includes at least one of a GPS antenna feedpoint, a Wi-Fi/BT antenna feedpoint, a main antenna feedpoint, and a diversity antenna feedpoint.

* * * * *